US005517768A

United States Patent [19]

Aviv

[11] Patent Number: 5,517,768

[45] Date of Patent: May 21, 1996

[54] APPARATUS AND METHOD FOR FINISHING PROCESSES

[76] Inventor: Zvi Aviv, Beit Horon, Mobile Post North Judea 90935, Israel

[21] Appl. No.: 251,985

[22] Filed: May 31, 1994

[30] Foreign Application Priority Data

May 31, 1993 [IL] Israel ..... 105862
Nov. 4, 1993 [IL] Israel ..... 107501

[51] Int. Cl.[6] ..... F26B 3/34

[52] U.S. Cl. ..... 34/255; 427/510

[58] Field of Search ..... 34/245, 250–254, 34/255–259, 266; 427/508, 510, 487, 492, 493, 496

[56] References Cited

U.S. PATENT DOCUMENTS 5,010,659 4/1991 Treleven ..... 34/269

OTHER PUBLICATIONS

"Wood Furniture Finishing Equipment Guide", No. I–236, De Vilbiss Ransburg Industrial Coating Equipment, an Illinois Tool Works Company, of Toledo, Ohio, pp. 2–8.

*Primary Examiner*—Denise L. Gromada
*Assistant Examiner*—Susanne C. Tinker
*Attorney, Agent, or Firm*—Lowe, Price, LeBlanc & Becker

[57] ABSTRACT

Apparatus for finishing of workpieces comprising: a beam generator for providing a line of sight; voltage activating beam impinging along the line of sight on a workpiece surface to be finished, thereby causing the workpiece surface to be charged with electrical charges having a first polarity; an electrostatic spray gun operative to direct onto the workpiece surface which is charged with electrical charges having the first polarity, a particle spray which is charged with electrical charges of a second polarity; and a high energy source which dries said workpiece sprayed by said particle spray by directing a substantially defined beam of energy onto a surface of said workpiece.

12 Claims, 17 Drawing Sheets

APPARATUS AND METHOD FOR FINISHING PROCESSES

FIELD OF THE INVENTION

The present invention relates to electrostatic finishing and drying of generally non-conductive substrates.

BACKGROUND OF THE INVENTION

Electrostatic finishing is a well-known technology. Generally, it operates on the principle of attraction between oppositely charged particles. Atomized coating material is given a negative charge using high voltage and low current, and directed at a grounded workpiece. Electrostatic spray guns are commercially available from DeVilbiss Ransburg Industrial Liquid Systems, an Illinois Tool Works Company, of Toledo, Ohio, U.S.A.

When electrostatic finishing is employed with non-conductive workpieces, such as wood furniture, the surface of such non-conductive workpiece is wetted to provide a conductive surface. Water is also employed in wood coating with water based paints or lacquers.

However, a number of problems arise when wood is wetted or treated with water based paints or lacquers. First, water based coatings cause the wood grain to rise in the wood, which subsequently requires sanding to restore the wood to a smooth finish. Second, water based coatings require long cure and flash times which demand increased factory floor space compared to coatings requiring shorter cure and flash times. When a wood substrate is coated with several layers, typically three or more, each coating layer must be dried before another coating layer can be applied thereon.

Drying is usually done in large ovens which are generally expensive. Since each coating layer must be dried separately, the cumulative drying time may be significant. The combination of expensive ovens and long drying times makes the finishing procedure expensive and raises the prices of coated furniture and painted substrates.

SUMMARY OF THE INVENTION

The present invention seeks to provide improved apparatus and techniques for electrostatic finishing with non-conductive workpieces.

It is another object of the present invention to provide an automated drying system which is capable of quick drying of substrates.

There is thus provided in accordance with a preferred embodiment of the present invention apparatus for electrostatic finishing of non-conductive workpieces including a line of sight beam generator, such as a laser, for providing a voltage activating beam, such as a laser beam, impinging on a workpiece surface to be finished, thereby causing the workpiece surface to be charged with electrical charges having a first polarity and an electrostatic spray gun operative to direct onto the workpiece surface which is charged with electrical charges having the first polarity, a particle spray which is charged with electrical charges of a second polarity.

In accordance with a preferred embodiment of the invention, a laser is mounted on the spray gun.

In accordance with an alternative embodiment of the invention, the laser is incorporated within the spray gun.

In both of the embodiments, the laser beam can be boresighted with the spray axis of the spray gun. Alternatively, the laser beam may be variably oriented or fixedly oriented with respect to the spray gun.

There is also provided in accordance with a preferred embodiment of the present invention a method for electrostatic finishing of non-conductive workpieces including the steps of providing a workpiece surface, such as a portion of a wooden article of furniture, providing a voltage activating beam, such as a laser beam impinging on a workpiece surface to be finished, thereby causing the workpiece surface to be charged with electrical charges having a first polarity and directing onto the workpiece surface which is charged with electrical charges having the first polarity, a particle spray which is charged with electrical charges of a second polarity.

The workpiece surface may comprise a wood surface such as a soft wood surface.

Further in accordance with a preferred embodiment of the present invention, the method also includes, prior to the step of providing, simultaneously with the step of providing or a short period after the step of providing, the step of spraying particles capable of being charged, such as pre-charged particles, onto the workpiece surface.

There is also provided in accordance with a preferred embodiment of the present invention a drying apparatus including at least one high energy source, such as an electromagnetic radiation source, which transmits a substantially defined beam of energy onto a surface of an object to be dried.

The high energy source may be a laser source or a xenon or halogen lamp source or a combination of laser source and lamps.

Additionally, the drying apparatus may include a scanner, such as a mirror mounted on dual axis gimbal, which maneuvers the beam of energy in a sweeping pattern substantially covering at least a pre-selected area of the object.

Preferably, the scanner may be controlled by a computer.

In accordance with another preferred embodiment of the present invention the drying apparatus includes a programmed CNC system for entering data relating to tracks which the high energy source follows.

Additionally, the drying apparatus also includes position sensors which locate the position of an object with respect to at least one reference point and scanner control system which operates the scanner in accordance with information received from the position sensors.

In yet another preferred embodiment of the present invention the drying apparatus also includes a conveyor for transporting products to the vicinity of said scanner and an identification system which determines a current product on the conveyor in the vicinity of the scanner, wherein the identification system provides data which is employed to define tracks which the scanner follows.

Additionally, the identification system may also include an identification tag associated with each of the products and an identification sensor which reads the data on the identification tag. Preferably, the identification sensor includes a transmitter for providing data to the identification tag.

Yet, additionally, the drying apparatus may further include at least one sensor coupled to the computer for generating data relating to at least a contour of a product to be dried and scanner control circuitry which utilizes the data relating to at least a contour of a product to be dried for operating the scanner to follow tracks along the contour of the product.

There is also provided in accordance with a preferred embodiment of the present invention a method for drying a wet coating on the surface of an object including the step of selectively scanning the object with a substantially defined energy beam in a pattern designed to substantially cover an area to be cured, until the coating is dry.

Preferably, the object is oriented with respect to a reference plane in a pre-determined orientation, and the selectively scanning step employs the pre-determined orientation to direct an energy beam in a pre-determined pattern.

Additionally, the method also includes the step of generating an image of at least a contour of the object, and the selectively scanning step employs the image to scan the object with an energy beam along a track defined by the image.

Additionally, an undercoat applied layer substantially absorbs electromagnetic radiation whereas an topcoat layer substantially does not absorb electromagnetic radiation.

A substantially absorbent material, such as aromatic, an aromatic derivative, an aliphatic or an aliphatic derivative, may be added to the undercoat layer if the undercoat layer is non-electromagnetic absorbent.

There is also provided in accordance with a preferred embodiment of the present invention an apparatus for finishing of workpieces including a beam generator for providing a line of sight, voltage activating beam impinging along the line of sight on a workpiece surface to be finished, thereby causing the workpiece surface to be charged with electrical charges having a first polarity, an electrostatic spray gun operative to direct onto the workpiece surface which is charged with electrical charges having the first polarity, a particle spray which is charged with electrical charges of a second polarity and a high energy source which dries the workpiece sprayed by the particle spray by directing a substantially defined beam of energy onto a surface of the workpiece.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
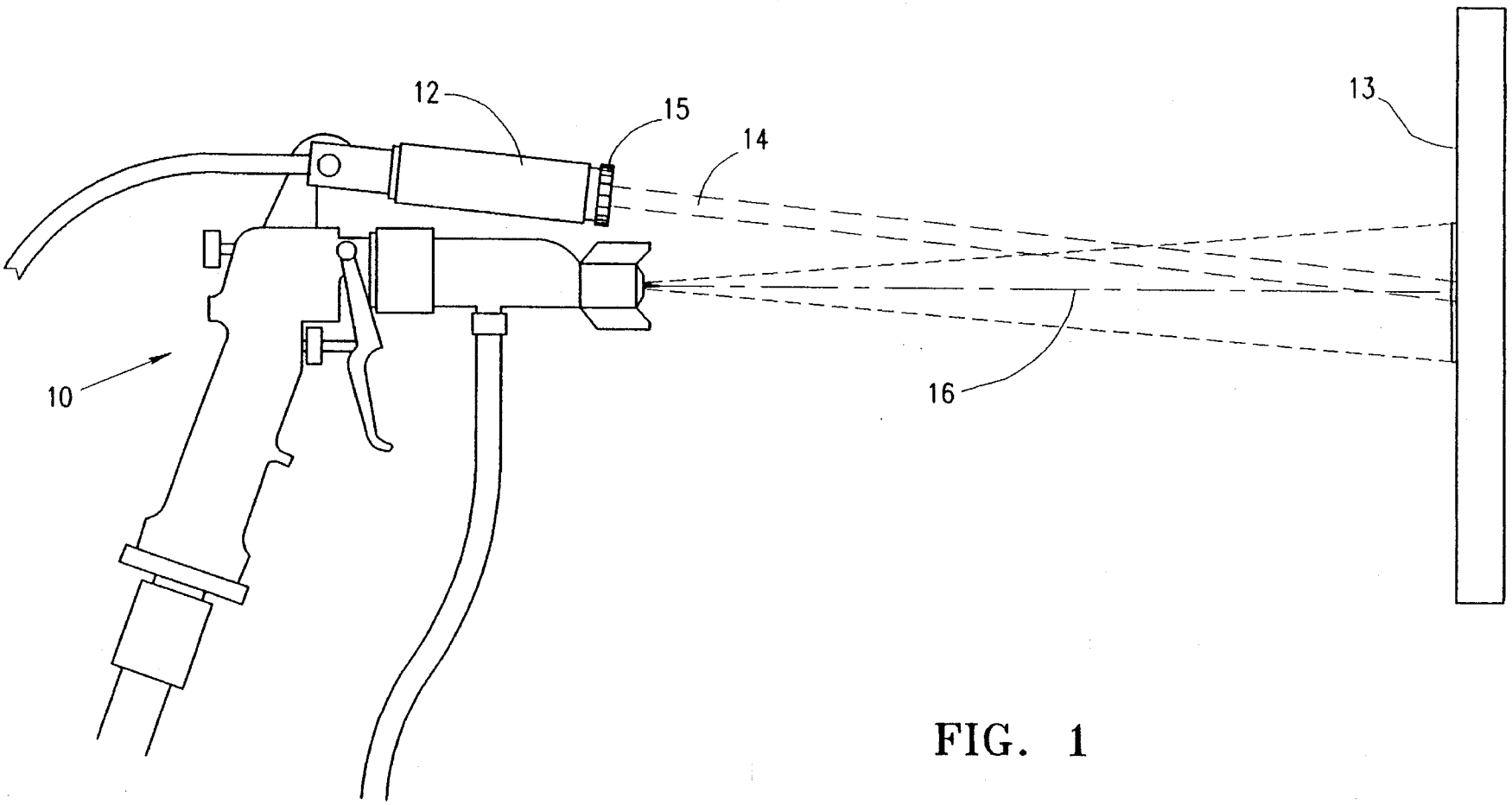
FIG. 1 is a simplified side view illustration of electrostatic finishing apparatus constructed and operative in accordance with a preferred embodiment of the present invention in a first operative orientation.

Reference is now made to FIG. 1, which illustrates electrostatic finishing apparatus constructed and operative in accordance with a preferred embodiment of the present invention.

A conventional electrostatic spray gun 10, typically of the type commercially available from DeVilbiss Ransburg Industrial Liquid Systems, an Illinois Tool Works Company, of Toledo, Ohio, U.S.A. has preferably mounted thereon apparatus for producing a "line of sight" voltage activating beam, such as a laser 12, which provides charging of a workpiece surface 13 to be coated.

Preferably, any suitable laser may be employed, such as a CO2 laser or an Argon laser or a semiconductor laser. Alternatively, other types of high power light sources may be used, such as xenon lamps, typically with power levels of 300–1000 W or halogen lamps. In such a case, where the light source is a wide spectrum light source, a filter (not shown) may be added in front of the light source to select the preferred suitable wavelengths which induce charging of the workpiece surface 13.

Other types of "line of sight" beams may also be employed such as, but not limited to, microwave or acoustical (ultrasound) beams. Any suitable power level may be employed, typically depending on the size of the workpiece surface area which is exposed to the activating beam. For example, the area exposed to laser 12 may be approximately 20–25 mm in diameter and a power level of less than 10 watts may be used. The power coverage per area may be adjusted optically. Any suitable wavelength may be employed, such as a wavelength of in the range of 3–5 microns.

Preferably, the impingement of a laser beam 14 emitted by laser 12 causes positive charges to predominate on the surface 13 because electrons escape from the area.

Electrostatic spray gun 10 preferably applies negative charges to coating particles emitted thereby, causing the coating particles to be attracted to the positively charged surface.

Alternatively, opposite polarities to those mentioned above may be employed.

The angular orientation between the laser beam 14 and the spray axis 16 of the spray gun 10 may be fixed or variable. In the operative orientation shown in FIG. 2, the laser beam 14 is parallel to the spray axis, but this need not necessarily be so. Preferably, the coating particles impinge on a surface at the same time that the laser beam impinges thereon. This is not absolutely necessary, however, inasmuch as the laser-induced charge on the surface tends to remain for a time after laser beam impingement, preferably retaining 85% of the charge for up to 30 minutes.

Figure 2:
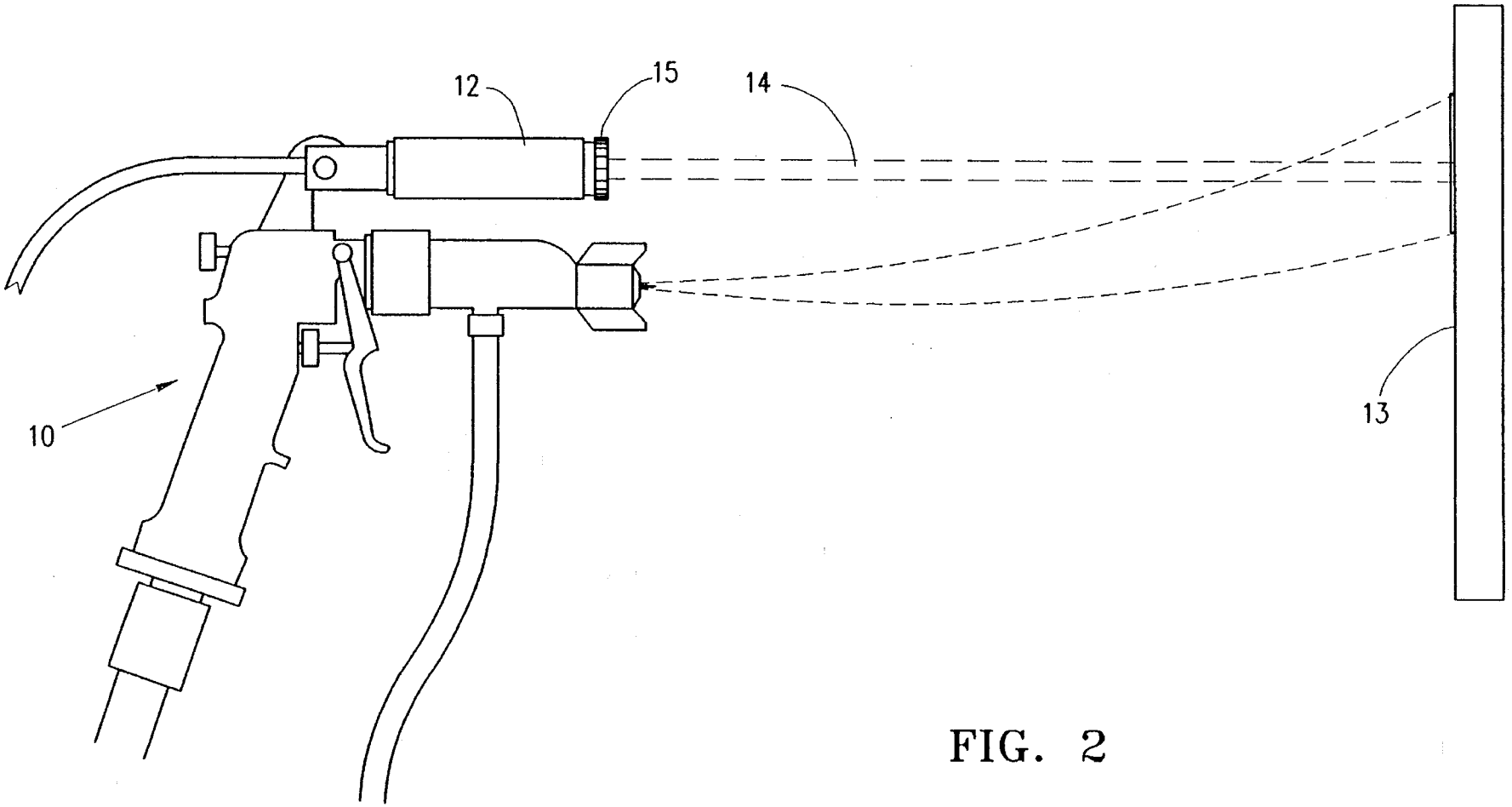
FIG. 2 is a simplified side view illustration of electrostatic finishing apparatus constructed and operative in accordance with a preferred embodiment of the present invention in a second operative orientation.
Figure 3:
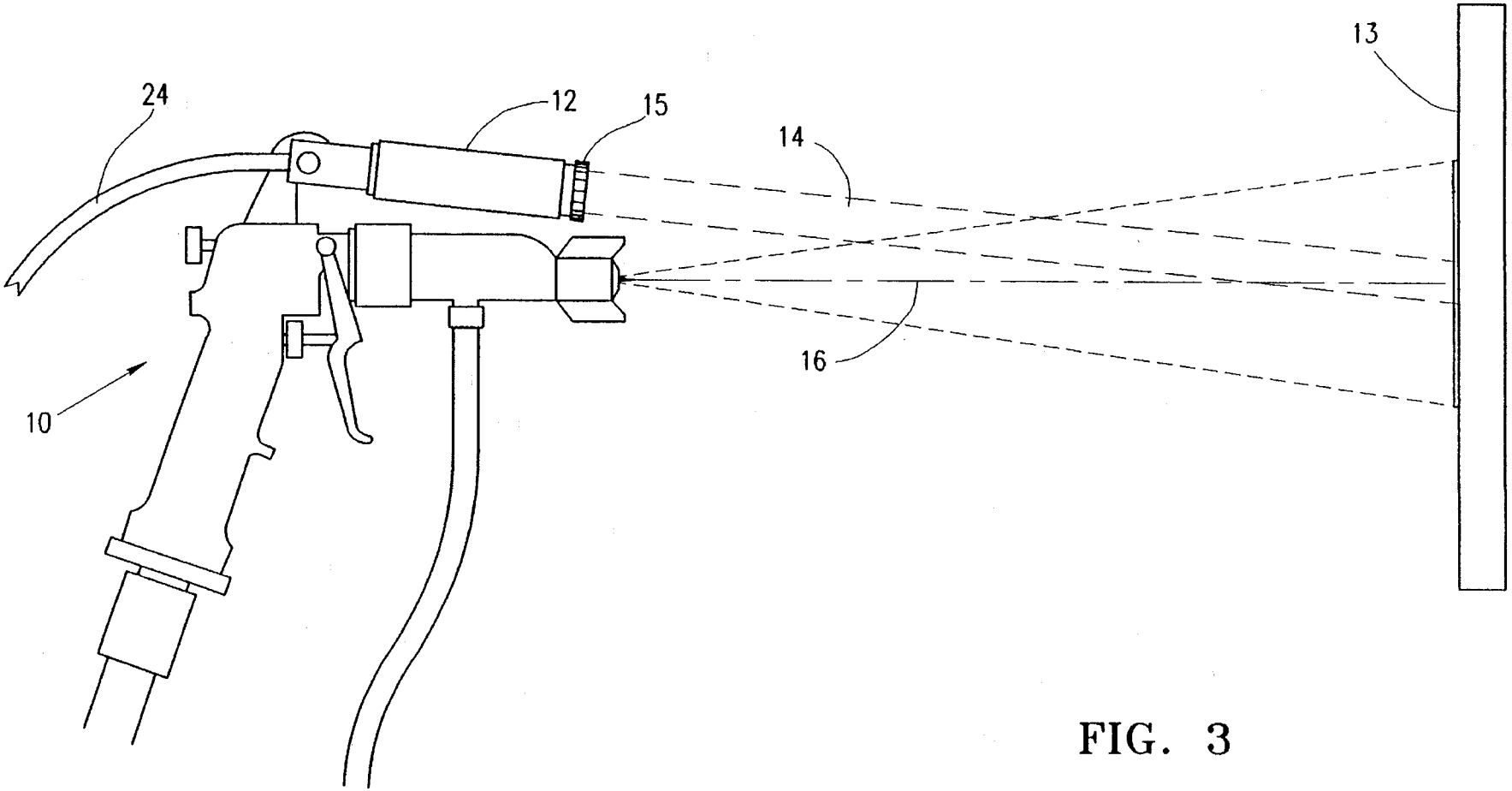
FIG. 3 is a simplified side view illustration of electrostatic finishing apparatus constructed and operative in accordance with a preferred embodiment of the present invention in a third operative orientation.

FIGS. 1 and 2 show the use of relatively narrow beam laser beams 14 and spray cones. FIG. 3 illustrates the use of optical apparatus 15, such as a diverging lens or a suitable optical or holographic element, to vary the width of the laser beam and the corresponding use of a wider spray cone.

Figure 4:
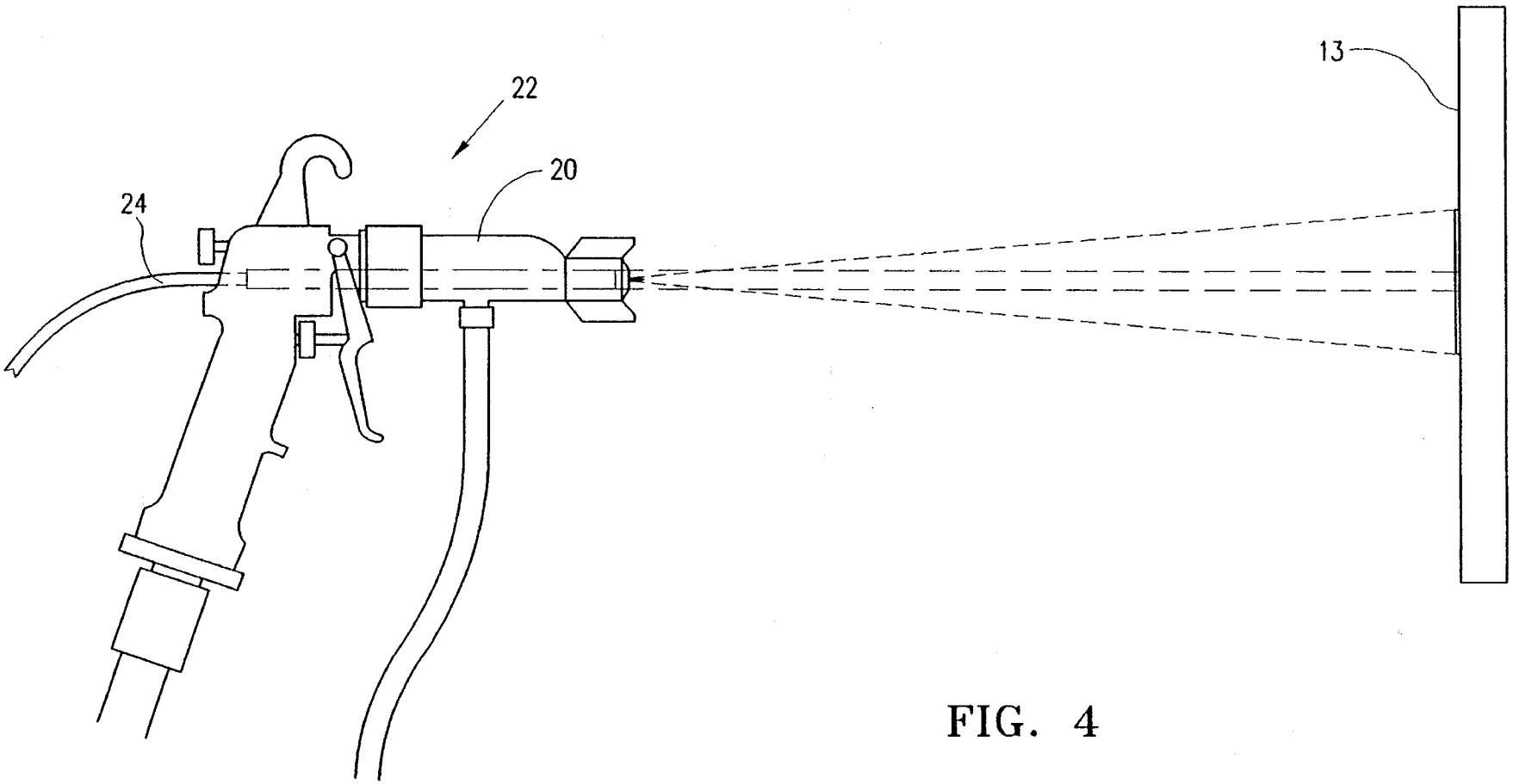
FIG. 4 is a simplified side view illustration of electrostatic finishing apparatus constructed and operative in accordance with another preferred embodiment of the present invention.

FIG. 4 illustrates an alternative embodiment of the present invention wherein a laser 20 is boresighted with electrostatic spray gun 22 as by the use of an optical fiber 24.

Figure 5:
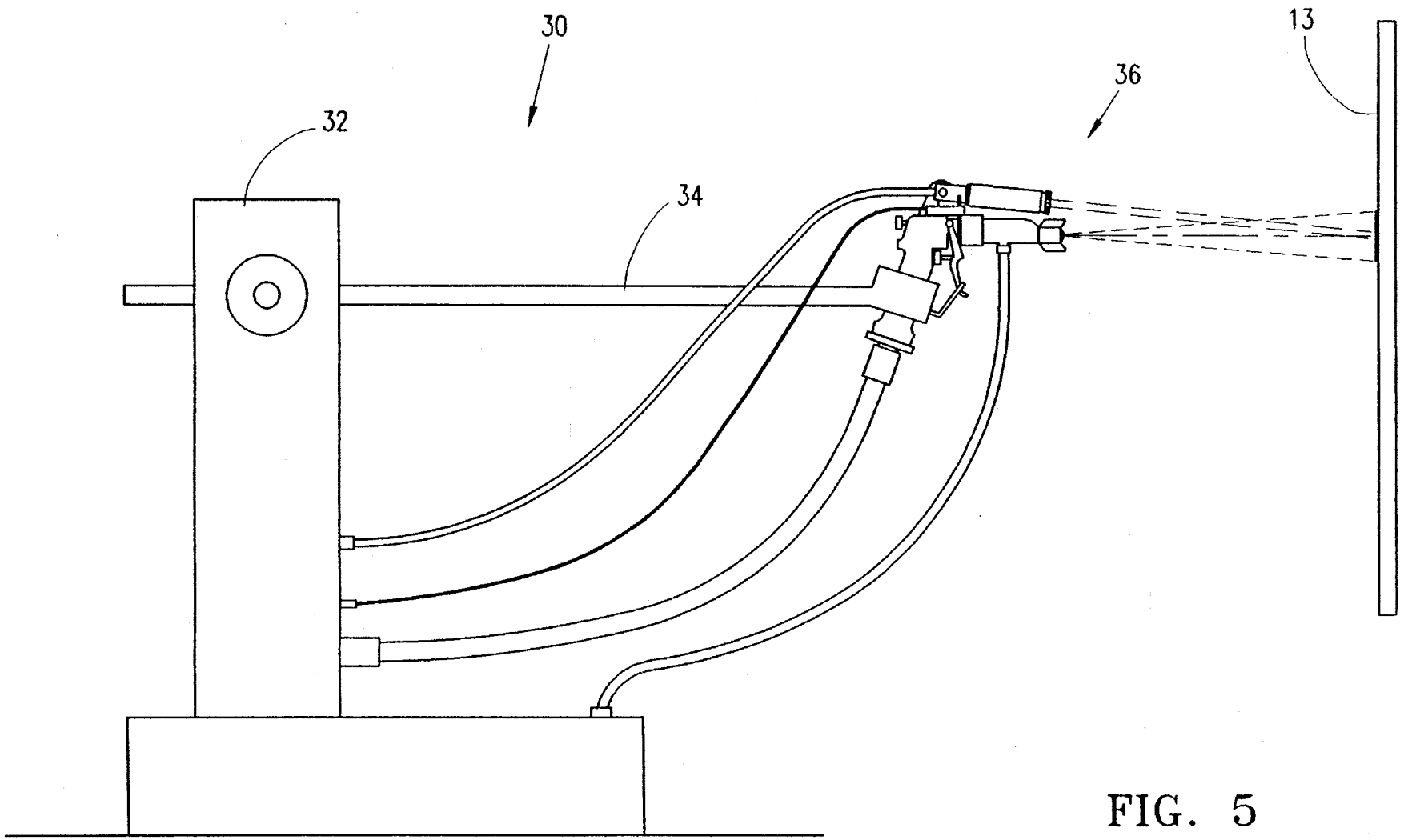
FIG. 5 is a generalized illustration of automatically operable electrostatic finishing apparatus constructed and operative in accordance with a preferred embodiment of the present invention.

FIG. 5 illustrates automatic electrostatic finishing apparatus 30 which typically incorporates a conventional industrial robot 32, having a robot arm 34 which supports and positions an electrostatic spray gun assembly 36 which may be similar to the spray gun assemblies shown and described above with reference to any of FIGS. 1–4.

Figure 6:
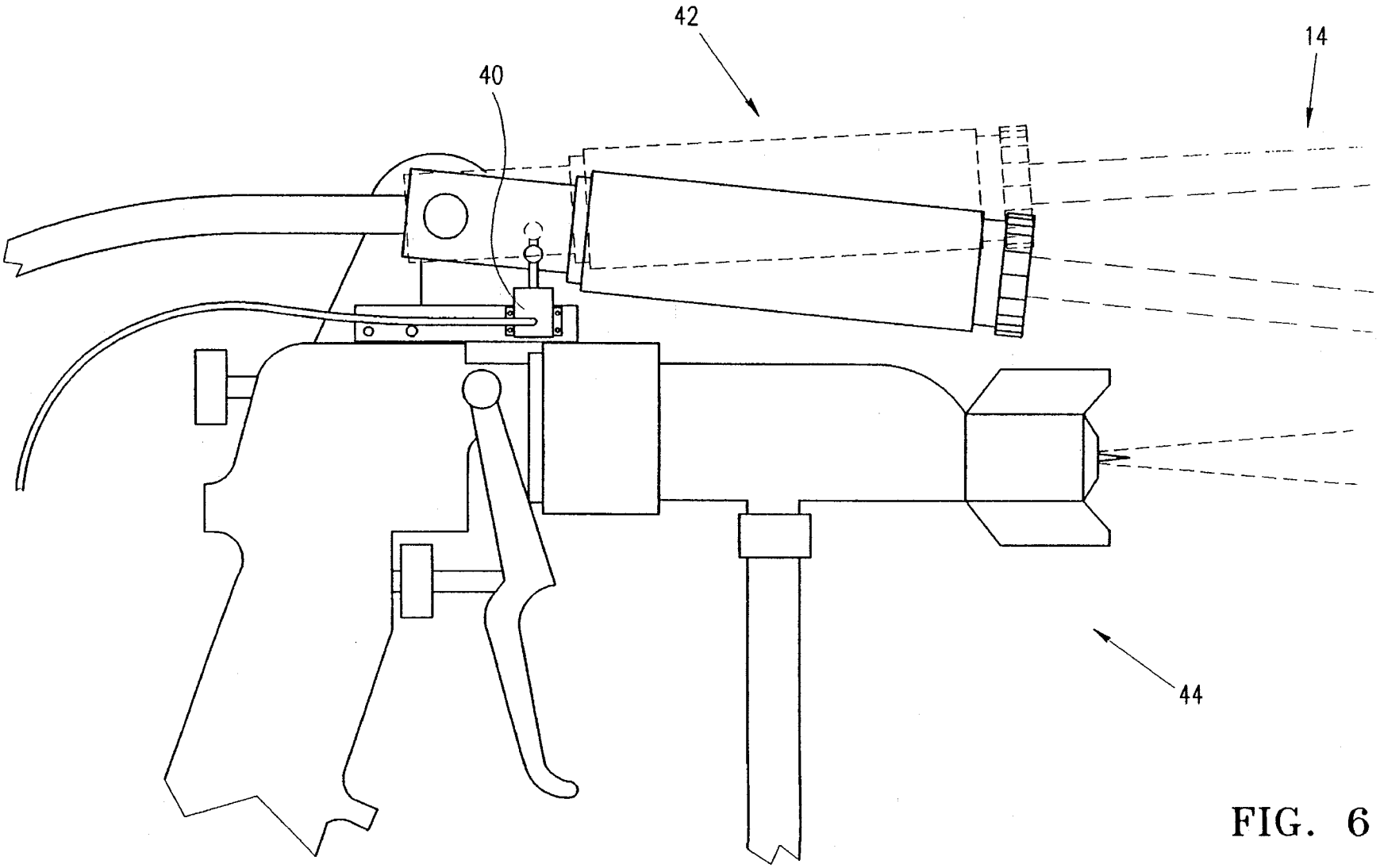
FIGS. 6 and 7 are illustrations of two alternative embodiments of an automatically operable electrostatic finishing gun assembly useful in the apparatus of FIG. 5.
Figure 7:
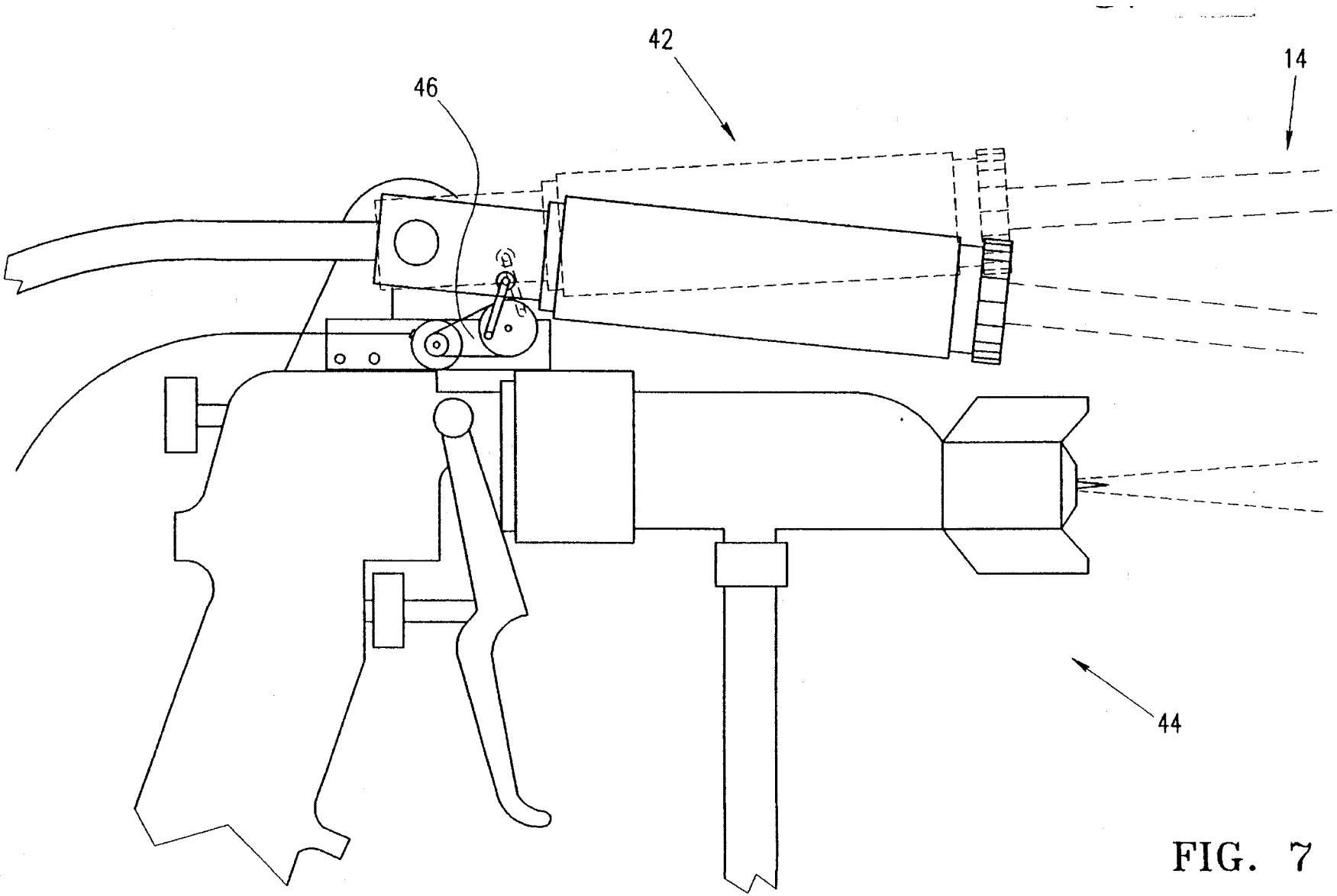

FIGS. 6 and 7 are illustrations of two alternative embodiments of an automatically operable electrostatic finishing gun assembly useful in the apparatus of FIG. 5. In the embodiment of FIG. 6 a piston assembly 40, which may be controlled by the robot 32, is operative to vary the orientation of a laser 42 relative to a spray head 44, as in vibratory motion, to prevent burning of the workpiece. The vibratory motion may comprise up-and-down motion, side-to-side motion, rotational motion or a combination of these.

In the embodiment of FIG. 7, vibratory motion of the laser 42 is provided by an eccentric drive mechanism 46.

The electrostatic finishing devices shown and described herein are useful in any of the following methods:

a. The laser beam directly irradiates a wood or other non-conductive workpiece, such as, but not limited to, a pine workpiece or other soft wood workpiece. Subsequently, the workpiece is electrostatically finished.

b. A stream of pre-charged particles is sprayed onto the workpiece, such as a stream of moist air, a stream of thermoplastic material or a stream of photo conductive material. The layer of pre-charged particles which accumulates on or adjacent the surface of the workpiece is irradiated by the laser beam so as to increase its voltage level. Finally, the workpiece is electrostatically finished.

c. A stream of pre-charged particles is sprayed onto the workpiece, such as a stream of moist air. Additionally, another stream of charge inducing particles, such as additive thermoplastic material, is simultaneously sprayed onto the workpiece and irradiated by the laser beam. The layers of charge inducing particles which accumulates on or adjacent to the surface of the workpiece is irradiated by the laser beam so as to increase its voltage level. Finally, the workpiece is electrostatically finished.

The apparatus and methods shown and described herein are useful for a variety of applications, such as, but not limited to, electrostatic finishing of wood workpieces such as wood furniture. The apparatus and methods shown and described herein are all useful for substantially any type of non-conductive workpieces such as hard woods of all kinds and soft woods of all kinds.

Figure 8:
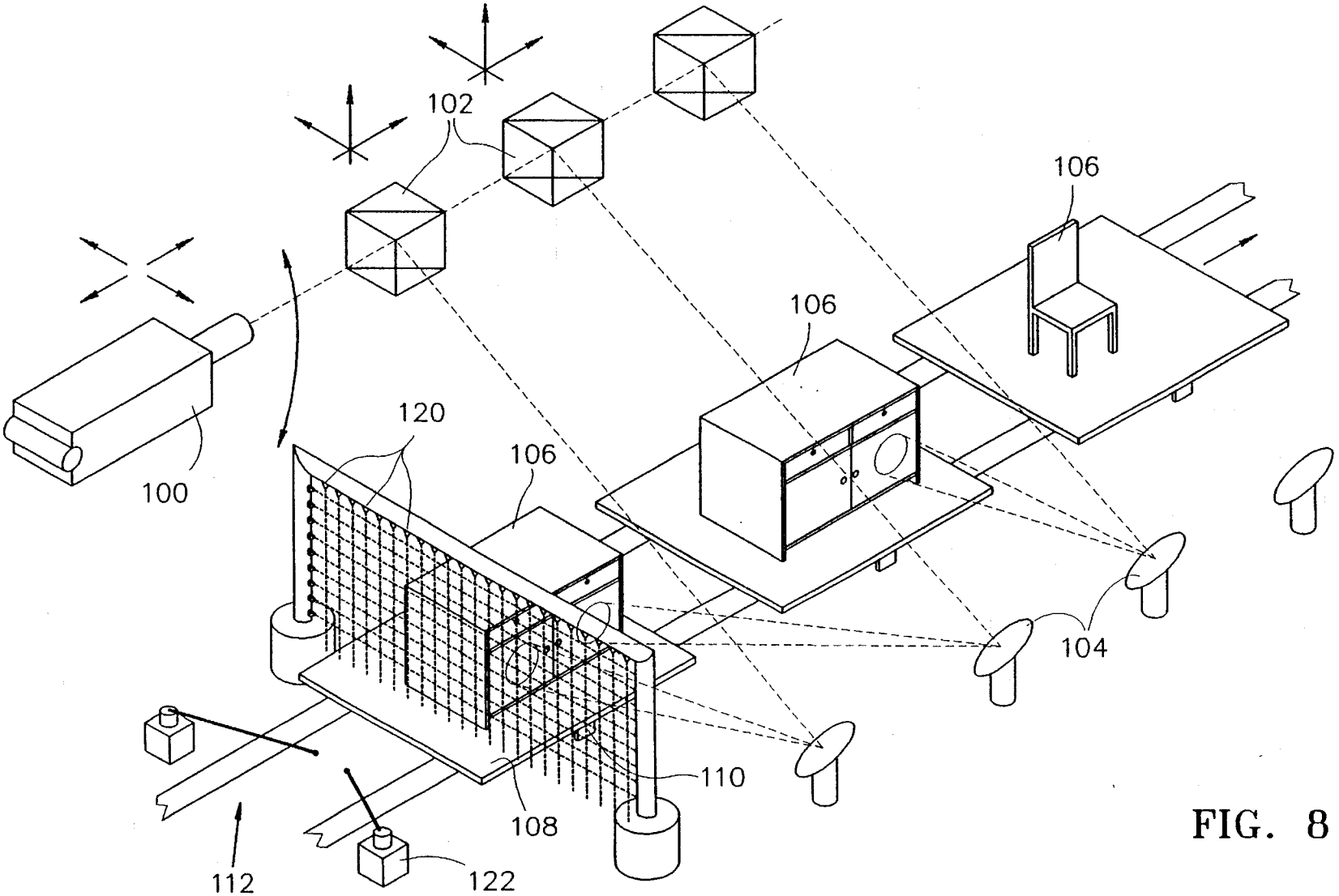
FIG. 8 is an illustration of a laser energy drying system operative in accordance with a preferred embodiment of the present invention.

After the workpiece is finished it is generally brought to a drying station of the type described in FIG. 8. In the drying station of FIG. 8 a high energy electromagnetic (EM) radiation source having high directional characteristics, such as a laser source 100, is used to provide heating energy. Laser source 100 transmits a laser beam to a plurality of beam splitters 102, each of which directs part of the beam's energy to a scanning mirror 104, which is preferably convex. Each beam splitter 102 is preferably fixed at an angle of 45 degrees with respect to the laser radiation axis and transmits part of the laser energy to an adjacent beam splitter 102 for reflection to a corresponding scanning mirror 104. Laser source 100 is mounted on a controllable chassis (not shown) which is capable of motion along three mutually orthogonal axes. This allows wide area coverage of the laser energy beam.

The motion of each scanning mirror 104 is controllable, as explained more fully below, so that the laser beam can be directed over a wide area. Each scanning mirror 104 generally diverges the energy beam slightly and directs it toward a product 106 in order to dry it.

Collectively, the controllable chassis and optical projection equipment such as beam splitters 102 and mirrors 104 are referred to herein as a "scanner". It will be appreciated that a drying system must handle a wide diversity of furniture shapes and sizes, thus there is a need for a scanning system for scanning large areas.

In a preferred embodiment of the present invention, laser source 100 is a laser having a power rating of approximately 10–30 W and which is capable of producing various wavelengths using appropriate optical filters. Alternative laser types may be used such as argon lasers, $CO_2$ lasers which may be either continuous or pulsed. Yet alternatively a xenon lamp with power levels of 300–1000 W with suitable filters may be employed to emit in a desired wavelength range.

As shown in FIG. 8, product 106 is preferably placed on a pallet 108 and introduced into a drying area by a conveyor 112, where product 106 is subjected to laser radiation by the scanner. Pallet 108 preferably contains an identification tag 110 mounted thereon for specifying which product 106 is presently situated thereon.

Preferably, limit switches 122 combined with a plurality of position sensors 120 sense the position and boundaries of product 106 with respect to a reference plane, which is preferably the plane defined by position sensors 120 as shown in FIG. 8. Alternatively, a video camera may replace position sensors 120 and supply a contour of product 106 to an image processing system (not shown) which provides the position of product 106 with respect to the reference plane.

Figure 9:
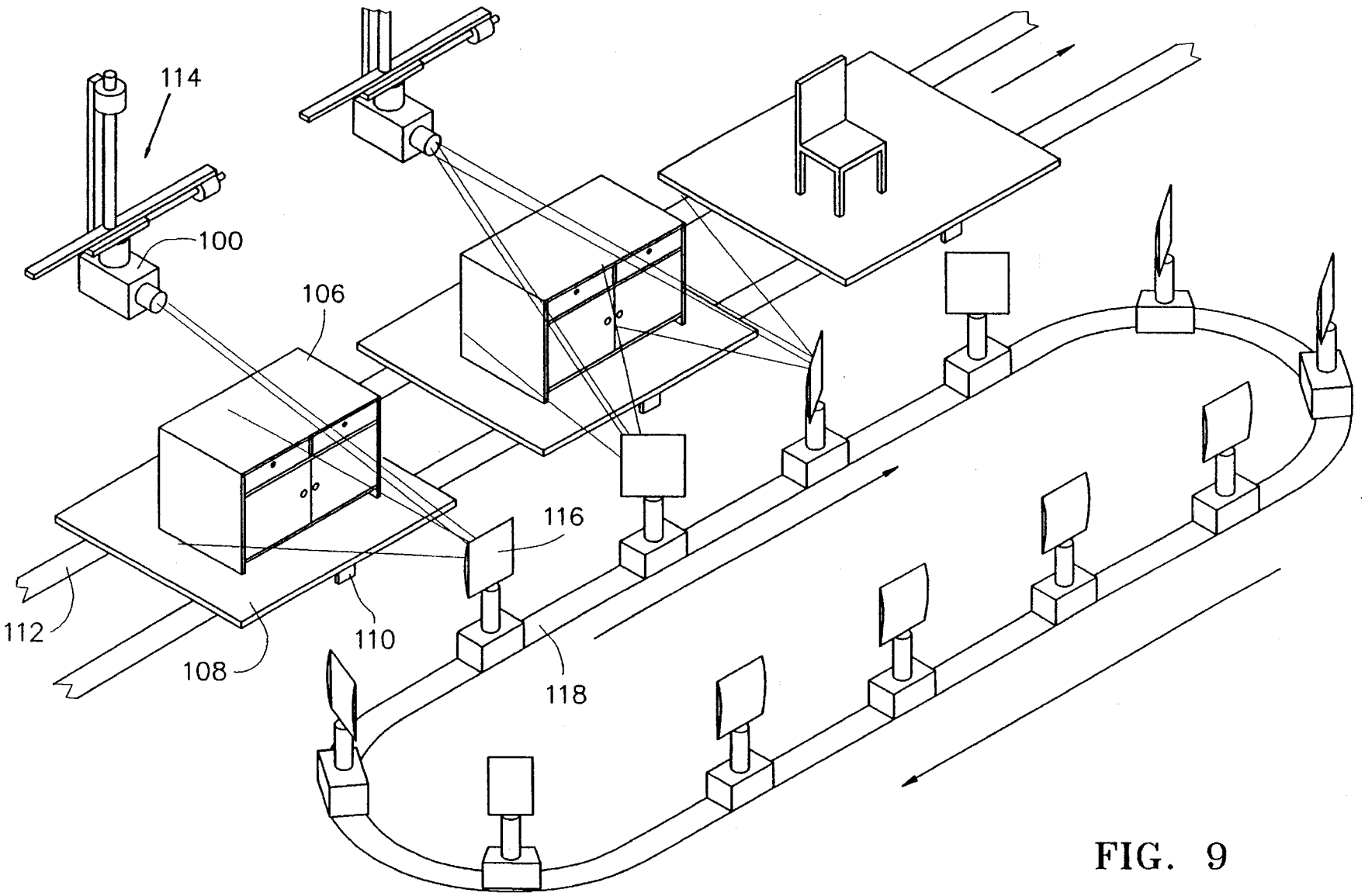
FIG. 9 is an illustration of a laser drying system operative in accordance with an alternative embodiment of the present invention.

FIG. 9 shows an alternative embodiment of the present invention. A plurality of convex mirrors 116 are mounted on and move along a mirror track line 118. A plurality of laser sources 100, each mounted on a positioning chassis 114, are directed toward convex mirrors 116. Convex mirrors 116 reflect the light radiated from the laser sources on product 106. Sensors similar to the sensors 120 of FIG. 8 (not shown in FIG. 9) detect the position of product 106 so that it may be scanned.

Figure 10A:
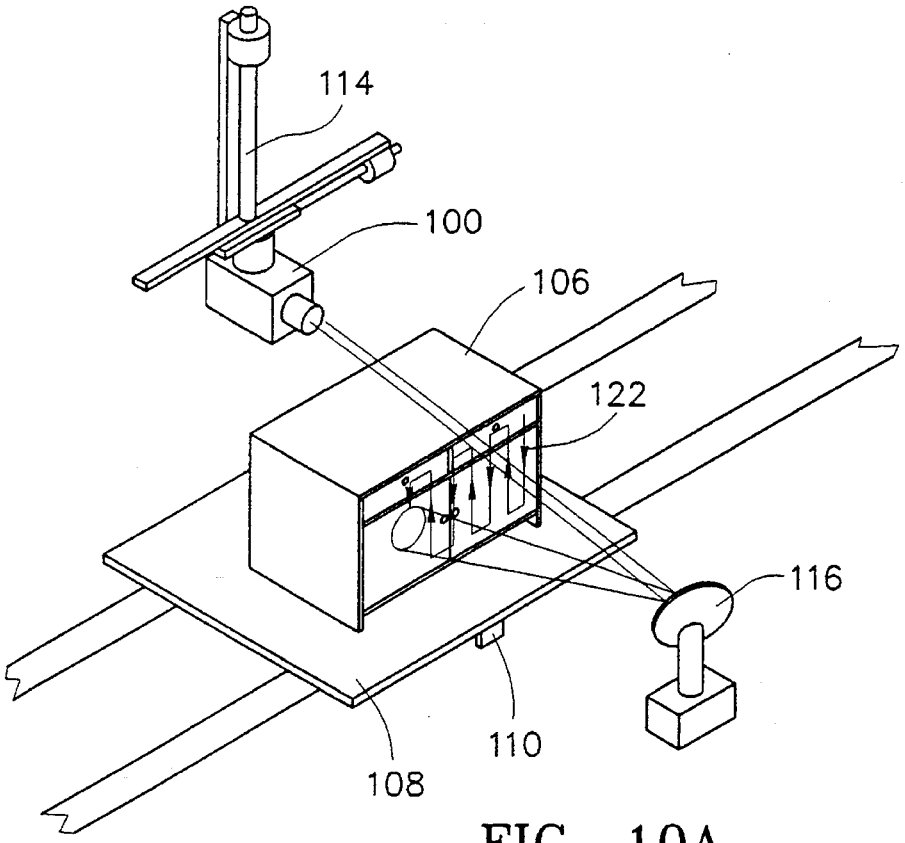
FIGS. 10A—10D are illustrations of sweeping patterns followed by a reflected laser beam and a direct laser beam on a product to be dried.
Figure 10B:
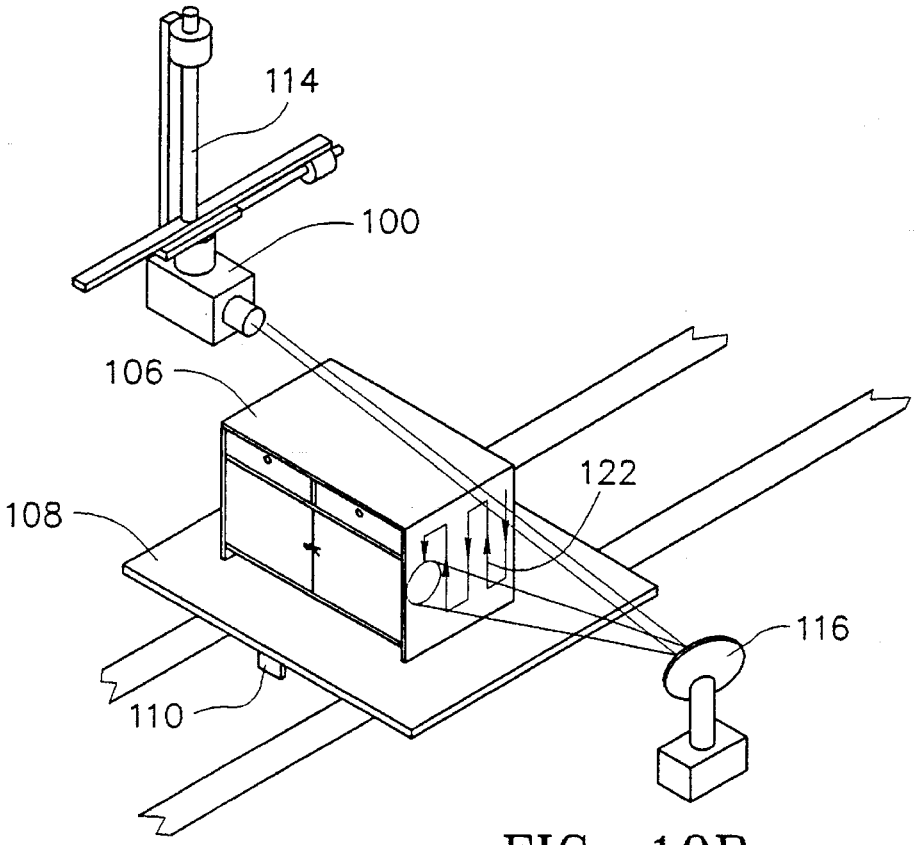

FIGS. 10A–10D are illustrations depicting a sweeping pattern 122 required to cover the surface area of product 106 in accordance with the systems depicted in FIGS. 8 and 9. As indicated by FIG. 10B, pallet 108 is rotated so that other surfaces of product 106 can be swept with laser energy.

Figure 10C:
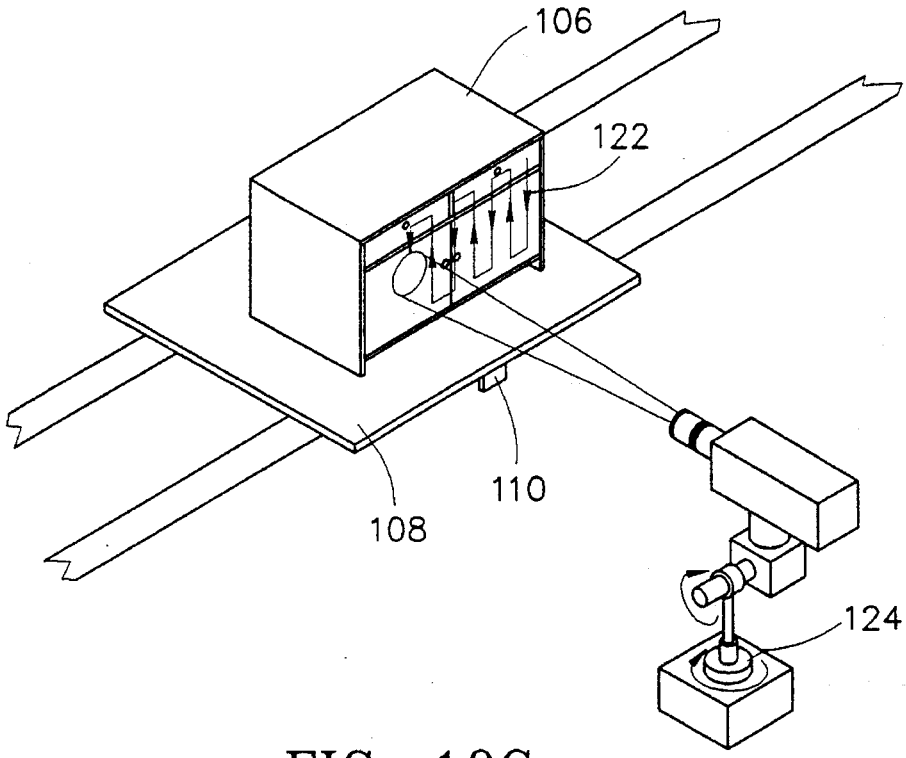
Figure 10D:
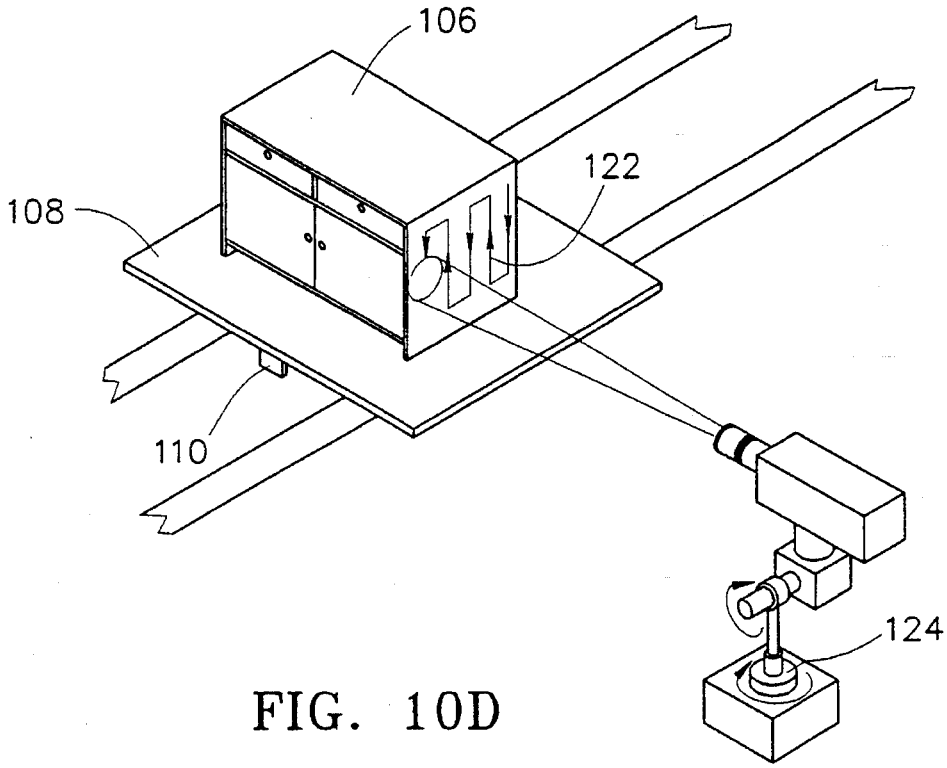

In an alternative embodiment illustrated in FIGS. 10C and 10D the laser sources 100 are mounted on a gimbal 124 or a robot arm and radiate separate parts of the product 106 by performing two-dimensional rotations. Thus, the sweeping pattern is provided by scanning with the laser sources directly and without use of reflecting mirrors.

Figure 11:
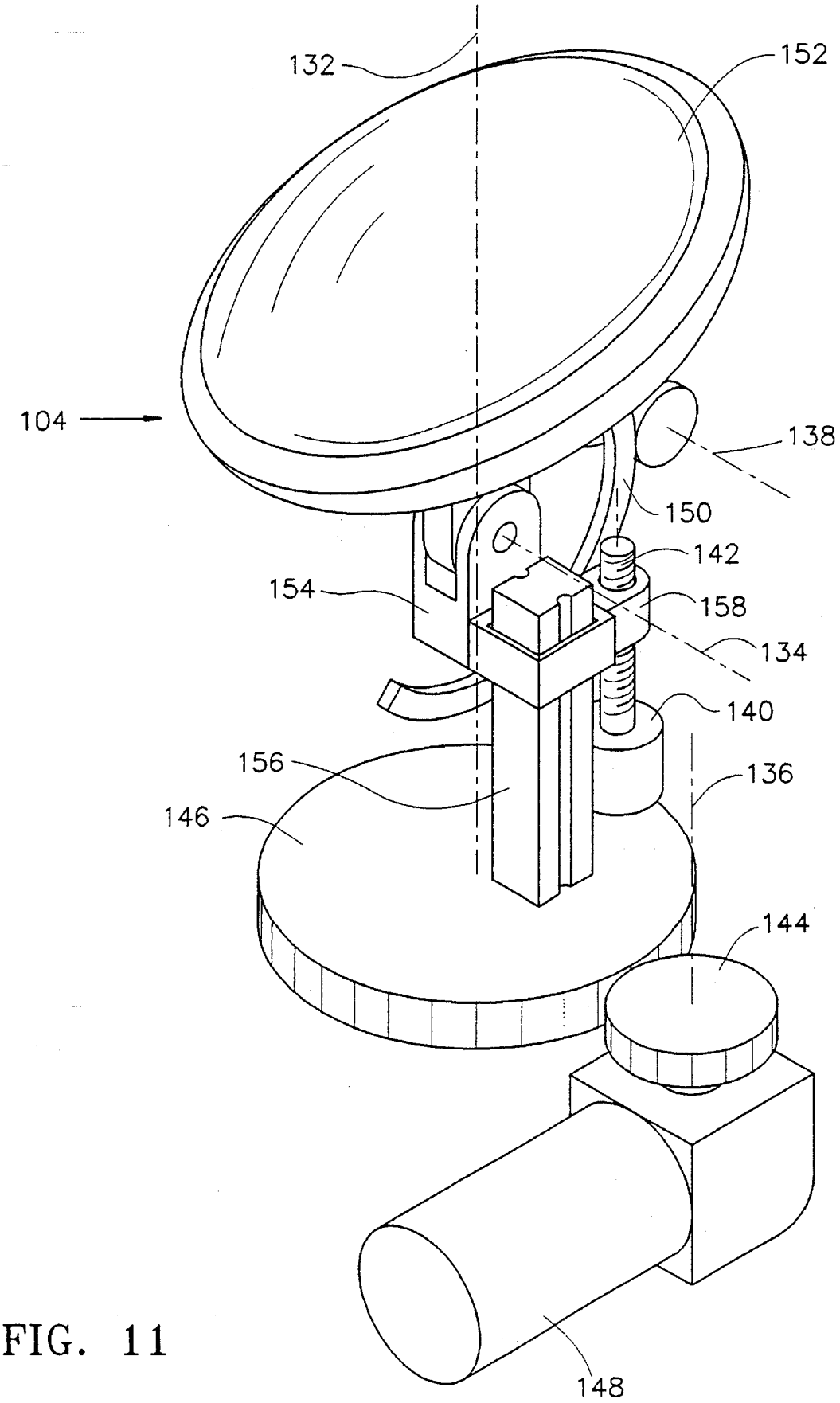
FIG. 11 is a detailed diagram of a scanning mirror in accordance with a preferred embodiment of the present invention.

Reference is now made to FIG. 11 which illustrates a scanning mirror 104 in accordance with a preferred embodiment of the present invention.

A convex mirror 152 is mounted on a bracket 150 and is also pivotly attached to an adjustable height hinge 154. An AC or DC stepper motor 138 controls rotation of mirror 152 about a horizontal axis 134. Rotation around this axis is preferably intended for effecting large scale vertical sweep of the laser beam over the product.

The height of hinge 154 is adjusted by a screw spindle 142 which is driven by a motor 140. A guiding nut 158 is attached to adjustable height hinge 154 and also connected to a linear guide 156 such that when motor 140 is activated, screw spindle 42 rotates and guiding nut 158 and hinge 154 move vertically. The vertical movement of mirror 152 is intended to extend the vertical reach of the laser beam, so that shelves etc. do not obstruct the laser beam. Linear guide 156 guides convex mirror 52 in an upward or downward direction. Angular motion of convex mirror 152 around a vertical axis 132 is controlled by a stepper motor 148 which is coupled to mirror 152 via a gear train 144 and 146. Mirror 152 is preferably capable of angular rotations of 90 degrees.

With the various rotations and translations described above, each scanning mirror 104 is capable of sweeping a laser beam over a broad area.

Figure 12A:
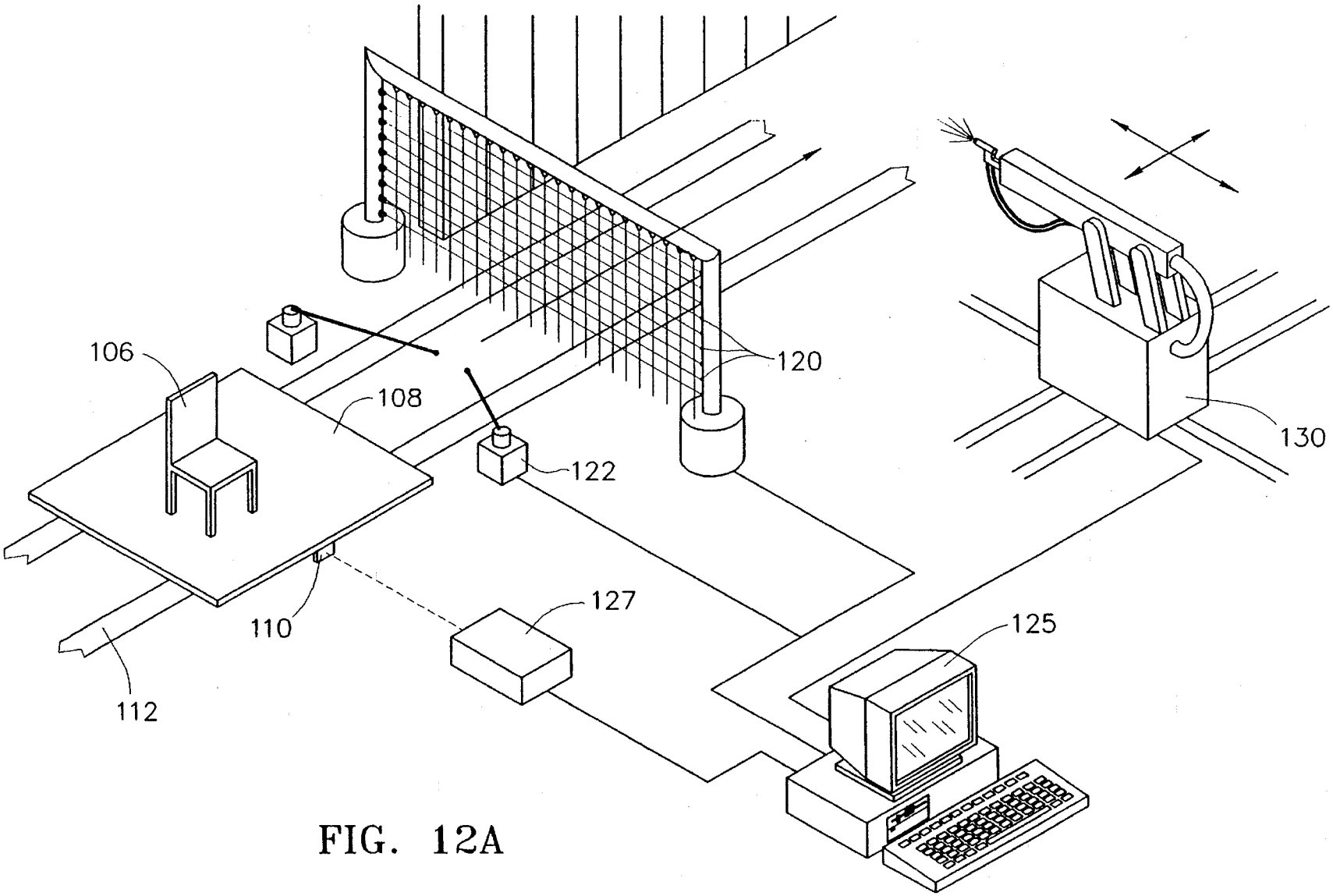
FIG. 12A and 12B are illustrations of a system for automatic spraying and drying of products in accordance with a preferred embodiment of the invention.

FIG. 12A shows the detection and spraying portion of the drying system in accordance with a preferred embodiment of the invention.

The detection and spraying portion includes a computer 125 connected to a tag sensor 127 and a robot spraying system 130. Tag sensor 127 reads identification tag 110 coupled to pallet 108 which is driven on conveyor 112 and provides input data relating to the position of product 106 on pallet 108 to a control software operable within computer 125, preferably by employing industry standard communication protocols. Tag sensor 127 preferably includes a combination radio transmitter and receiver that remotely provides data to and reads data from identification tag 110 without any physical contact.

Information may be transmitted and received while pallet 108 is moving, thus enhancing conveyor 112 efficiency. An example of an identification system as described above is the PERMID electronic identification system commercially available from Saab Automation Ltd. of Sweden, and available in Israel from "Apkon Bakara v'Automatcia" Ltd., Petah Tikvah.

Once product 106 is identified and accurately located, robot spraying system 130 sprays product 106 in accordance with control commands provided by the computer 125, in a manner described more fully below.

Figure 12B:
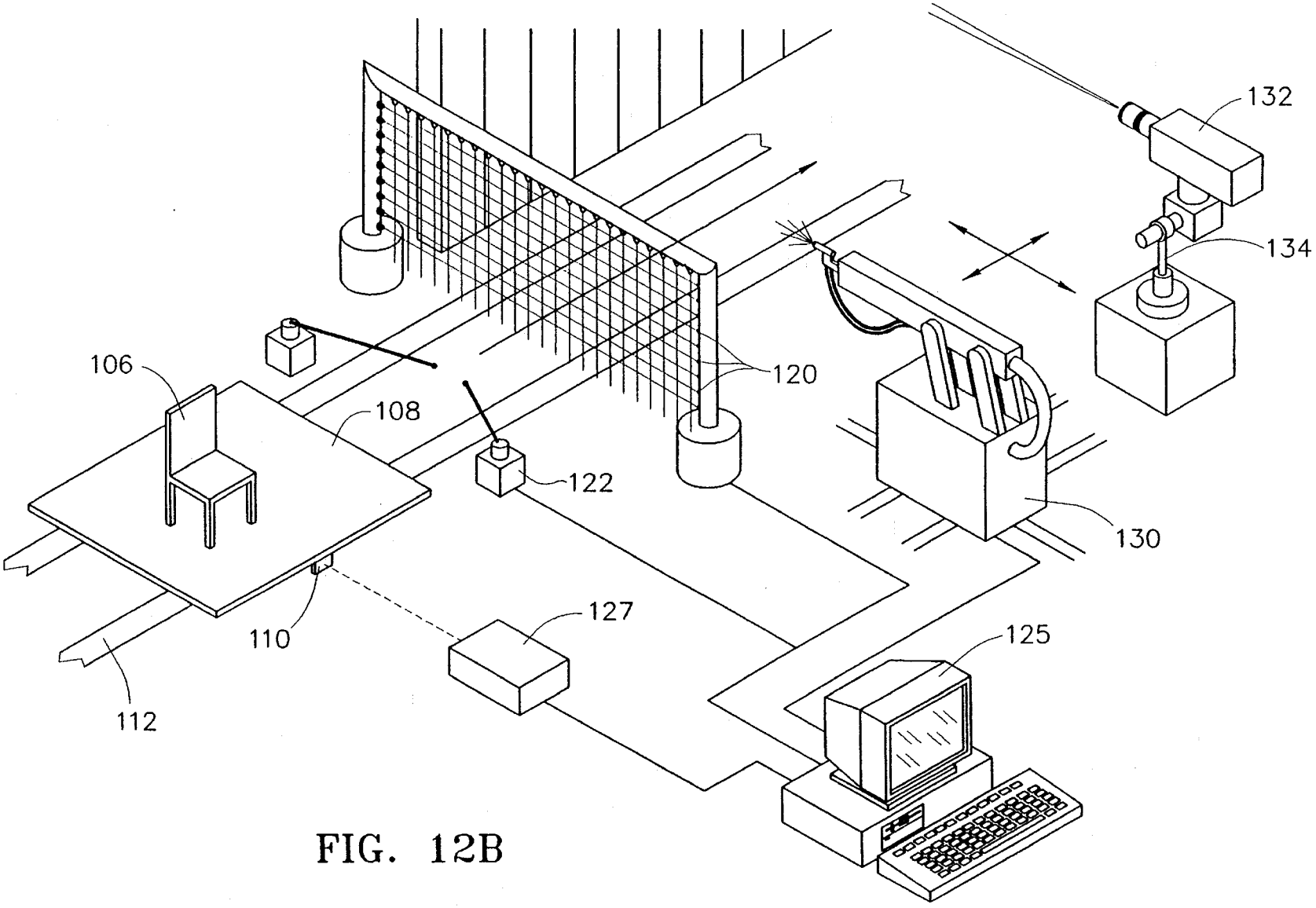

FIG. 12B is an illustration of a spraying and drying station which includes the portions described in FIG. 12A and a drying system in accordance with a preferred embodiment of the present invention.

The station of FIG. 12B includes a laser source 132 which is positioned on a gimbal 134 or a robot arm with several motion axis. Laser source 132 moves and rotates in accordance with control commands received from the computer 125.

Figure 13:
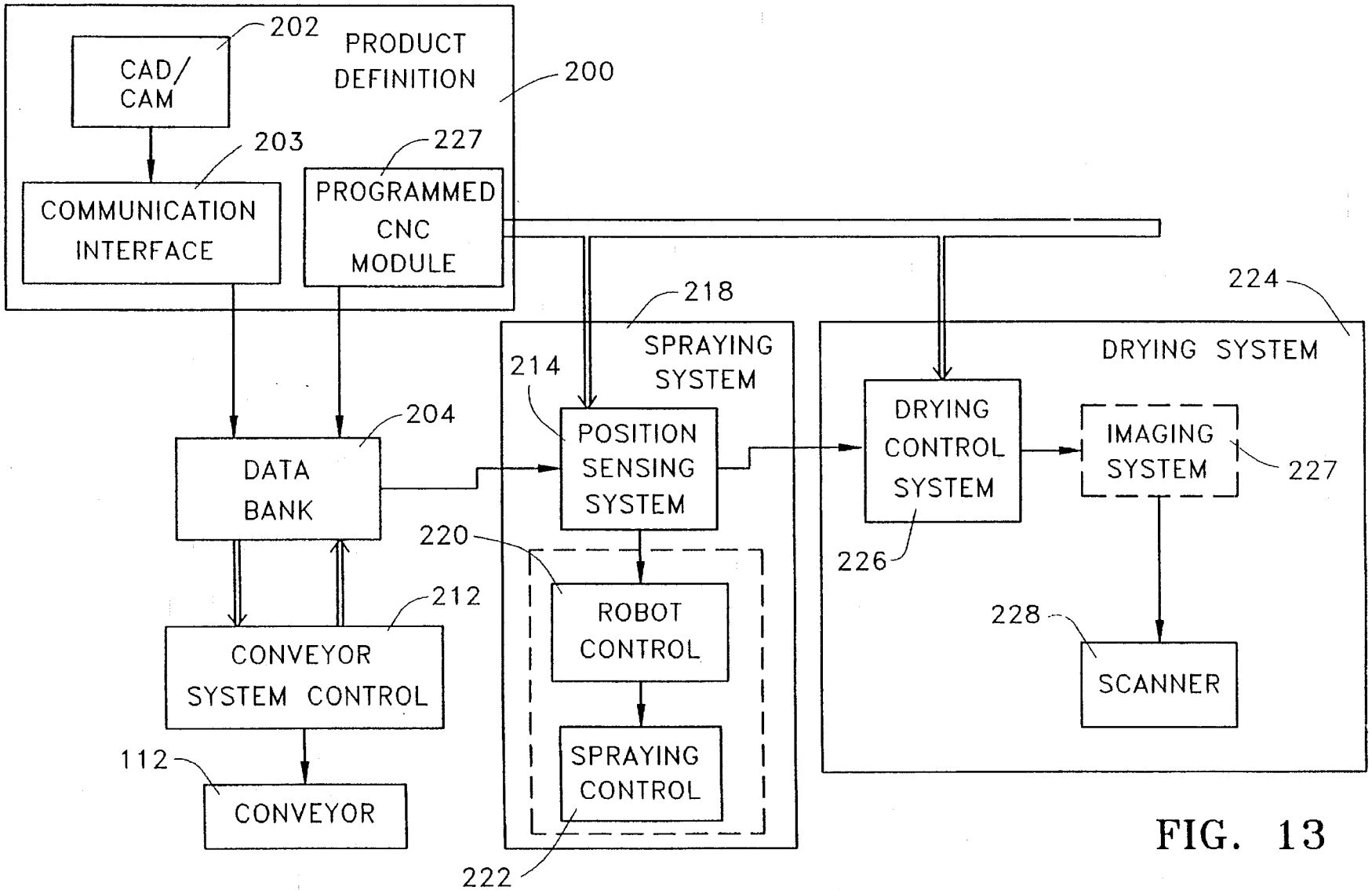
FIG. 13 is a block diagram of a spraying and drying system in accordance with a preferred embodiment of the present invention.

Reference is now made to FIG. 13 which is a block diagram of sub-systems and modules employed in the implementation of a coating and drying system in accordance with a preferred embodiment of the invention as depicted in FIGS. 8–12B.

A product definition block 200 comprises a CAD/CAM module 202 which is employed to define the spatial dimensions of a product to be sprayed and dried. CAD/CAM module 202 preferably defines not only the complete spatial dimensions of product 106, but also the areas of product 106 that are to be sprayed and dried. Additionally, CAD/CAM module 202 defines the expected orientation of product 106, as it is placed on pallet 108, with respect to a reference plane preferably defined by position sensors 120 (FIG. 8). The reference plane provides the scanner with a "trigger point" because as soon as product 106 passes within the field of view of sensor 120, the position and orientation of product 106 is determined and the scanner moves a laser beam in a pre-determined sweeping path originating from the reference plane.

In order to improve the effectiveness, products 106 are placed on pallets 108 in a pre-determined orientation which is defined by CAD/CAM module 202. To aid in accomplishing this, diagrams of the required orientation per product 106 are preferably displayed in a factory loading area so that persons loading products 106 onto pallets 108 will load the products accordingly.

A programmed CNC module 227 determines a scanning path for the laser beam which provides an efficient coverage of the surface area of product 106. The programmed CNC system is programmed by an operator which moves a robot arm or laser chassis over a particular path thus "teaching" the system the required path. The operator enters data relating to points on the route to a computer and the robot arm follows the track according to commands from the computer. Thus, by simulating the manual maneuvers, a reproducible scanning path is easily programmed from a determined origin.

Programmed CNC module 227 is preferably utilized "off-line", that is, sweeping programs are produced before mass production spraying and drying begins. Preferably, as mentioned before, all equivalent products 106 are oriented in the same position with respect to the reference plane, as defined in CAD/CAM module 202, in order to accurately sweep laser energy onto product 106.

A data bank 204 contains spatial configuration information for various products 106, as defined in CAD/CAM module 202. Data bank 204 also maintains corresponding spraying/sweeping path programs for each product type, preferably derived from programmed CNC module 227.

Additionally, since plants generally tend to use various CAD/CAM systems, a communication interface module 203 is preferably employed to couple CAD/CAM module 202 to data bank 204.

A conveyor system control module 212 is operable to keep track of pallets 108 and products 106 placed thereon which are driven along conveyor 112 to spraying and drying stations. In order to perform this task conveyor system control module 212 receives data from data bank 204. Conveyor system control module 212 also provides data relating to conveyor 112 control to data bank 204.

Pallets 108 and products 106 are preferably identified by an electronic tag identification system, comprising identification tag 110 and sensor 127 (FIGS. 12A and 12B). Conveyor module 212 maintains a list of products 106 currently on conveyor 112. Alternatively, lists of products placed on conveyor 112 may be manually entered into a computer, such as computer 125 of FIGS. 12A and 12B.

Product identification data is stored in data bank 204 for access by other modules within the system in order to keep track of the products that are currently processed.

After product identification is determined, an automated spraying system 218 is employed to coat product 106. Location of product 106 is determined by a position sensing system 214 which employs limit switches 122 and position sensors 120 (FIGS. 12A and 12B) as well as operating control software for interfacing with computer 125. Spraying system 218 retrieves identification data, spatial dimensions, and orientation of product 106 from data bank 204 and employs the information to effectively coat product 106 with a sprayed paint. A robot control module 220 and a spraying control module 222 control the maneuvers of a robot spraying system 130 (FIGS. 12A and 12B).

After the product 106 is coated it is driven to a drying system 224. Drying system 224 includes a drying control system 226 which receives identification data, spatial configuration information and control data from data bank 204. Drying control system 226 also receives position data from position sensing system 214. Data inputs from data bank 204 and position sensing system 214 are employed to operate the scanner which sweeps the laser beam.

In an alternative embodiment of the present invention a combination of manual spraying system and an automatic drying system may be employed. In that case position sensing system 214 is coupled to drying system 224 and system 218 is excluded.

In another preferred embodiment of the present invention, an imaging system 227 is employed to generate an image of product 106. Imaging system 227 provides data to a scanner 228 for controlling a laser or a set of mirrors.

It is to be appreciated that if the combination of position sensors 120 and limit switches 122 as described in FIG. 8 is employed, product definition block 200 may be excluded and the data from position sensors 120 and limit switches 122 may be employed to drive the scanner via an suitable interface (not shown).

Figure 14:
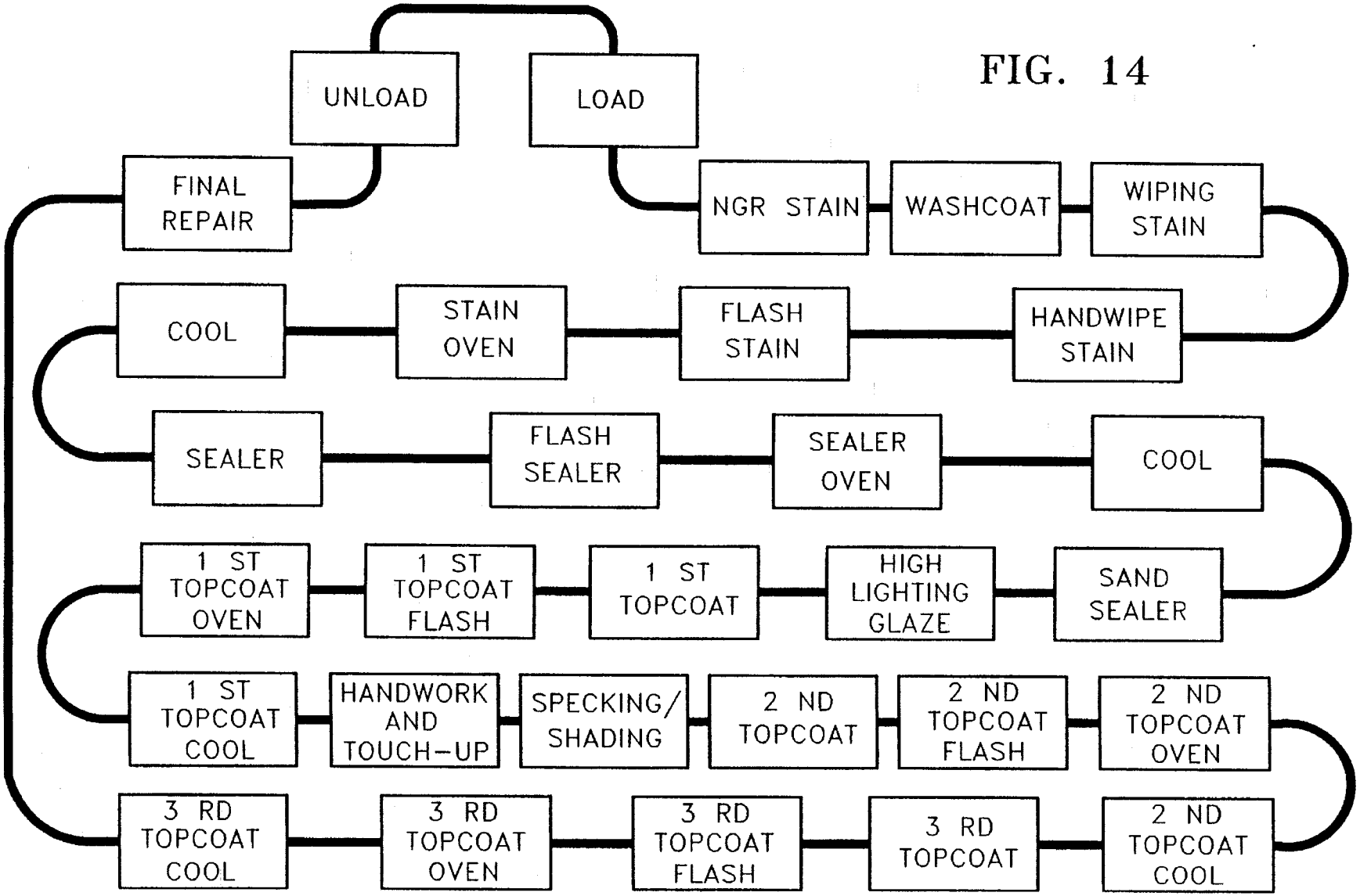
FIG. 14 is a block diagram of a typical furniture finishing process as found in the prior art.

Reference is now made to FIG. 14 which is a block diagram of a typical furniture finishing process and system as described in a guide named "Wood Furniture Finishing Equipment Guide", No. I-236, published by DeVilbiss Ransburg Industrial Coating Equipment, an Illinois Tool Works Company, of Toledo, Ohio, U.S.A., the disclosure of which is incorporated herein. Generally, a number of coating layers are applied. The usual furniture finishing order is:

i) water based stains 420;

ii) washcoat and sealers 422;

iii) first topcoat layer 424;

iv) second topcoat layer 426; and v) third topcoat layer 428.

Stains 420 and sealers 422 are often referred to as undercoats or basecoats. Topcoat layers 424, 426 and 428 are usually lacquer or solvent based.

Figure 15:
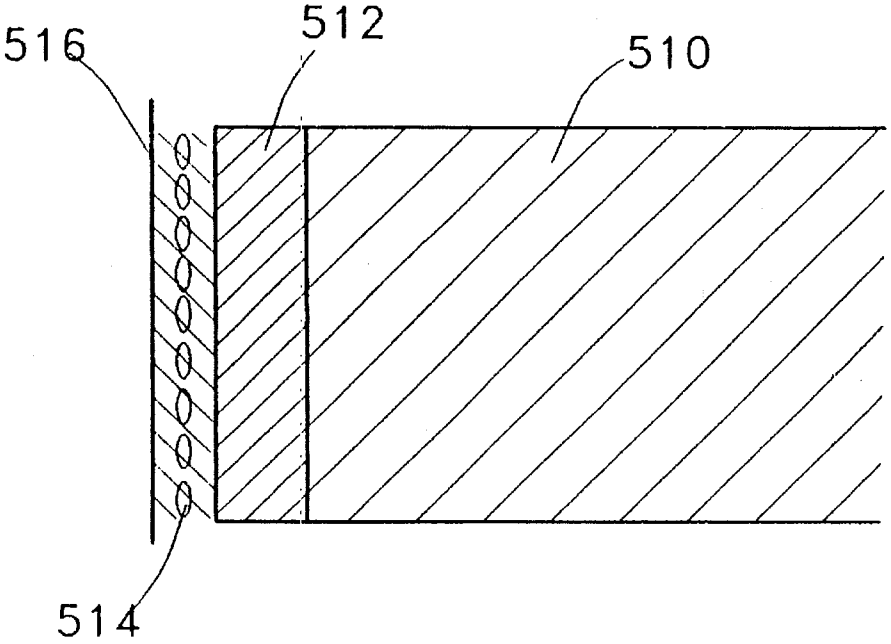
FIG. 15 is an illustration of coating layers on a wood furniture surface.

Reference is now made to FIG. 15 which is an illustration of coating layers on a wood furniture surface.

In a preferred embodiment of the present invention, electromagnetic radiation absorbing material, such as aromatic, heter-aromatic, aliphatic or heter-aliphatic compounds, such as anthraquinon or its derivatives, is mixed with stain 420 and/or sealer 422 of FIG. 14. The amount added is dependent on the absorption properties of the compound used. The absorbent material, combined with stain 420 and sealer 422 of FIG. 14 form an inner layer 512 on wooden product surface 510. Topcoat lacquers 424, 426 and 428 of FIG. 14, form an upper layer 516. Solvents 514 exist within upper layer 516. When wooden product surface 510 is radiated with laser energy, topcoat upper layer 516, including solvents 514, is preferably transparent to laser light of a particular pre-defined wavelength, but laser energy is absorbed by the inner layer 512 of sealer and the wooden product surface 510. Thus, upper layer 516 is heated by the irradiated inner layer 512 which transfers heat to the upper layer. In this manner, top coating lacquer 424, 426, or 428 is heated from the inside towards the upper layer so that bubbles and blisters, which would otherwise form on the topcoat layers, are avoided.

It is to be appreciated that wood itself is an absorbing material. Moreover, stains 420, sealers 422 and topcoats 424, 426 and 428 may all be absorbing materials depending on the wavelength of the electromagnetic radiation employed.

Typically, when the systems and methods of the present invention are employed, a product is dried in time periods of about 3.5 minutes when a 40 W laser beam is employed to cover a wooden area of 100 centimeters squared. Minimum wood grain rise occurs despite the use of water-based coatings on furniture. Sanding after coating is reduced and large expensive heat ovens are not required.

It will be appreciated by persons skilled in the art that the present invention is not limited by what has been particularly shown and described hereinabove. Rather the scope of the present invention is defined only by the claims which follow:

I claim:

1. Drying apparatus comprising:

at least one high energy source which transmits a beam of energy onto a surface of an object to be cured; and a beam shaper operable to substantially define said beam of energy which is transmitted onto said surface of an object to be cured; and also comprising a scanner which receives said beam of energy and maneuvers said beam of energy in a sweeping pattern substantially covering at least a pre-selected area of said object.

2. Drying apparatus according to claim 1 and wherein said high energy source is an electromagnetic radiation source.

3. Drying apparatus according to claim 1 and wherein said electromagnetic radiation source is a laser transmitter.

4. Drying apparatus according to claim 1 and wherein said electromagnetic radiation source is a lamp.

5. Drying apparatus according to claim 1 and wherein said scanner comprises at least one mirror mounted on a gimbal adapted to rotate and tilt said mirror.

6. Drying apparatus according to claim 1 and also comprising a computer which controls the operation of said scanner.

7. Drying apparatus according to claim 1 and also comprising a programmed CNC system for entering data relating to tracks which said high energy source follows.

8. Drying apparatus according to claim 1 and also comprising:

position sensors which locate the position of an object with respect to at least one reference point; and scanner control system which operates said scanner in accordance with information received from said position sensors.

9. Drying apparatus according to claim 1 and also comprising:

a conveyor for transporting products to the vicinity of said scanner; and an identification system which determines a current product on said conveyor in the vicinity of said scanner, wherein said identification system provides data which is employed to define tracks which said scanner follows.

10. Drying apparatus according to claim 9 and wherein said identification system also comprises an identification system also comprises:

an identification tag associated with each of said products; and an identification sensor which reads the data on said identification tag.

11. Drying apparatus according to claim 10 and wherein said identification sensor also comprises a transmitter for providing data to said identification tag.

12. Drying apparatus according to claim 6 and also comprising:

at least one sensor coupled to said computer for generating data relating to at least a contour of a product to be dried; and scanner control circuitry which utilizes said data relating to at least a contour of a product to be dried for operating said scanner to follow tracks along the contour of said product.

* * * * *